United States Patent [19]

Kinser

[11] 4,012,037

[45] Mar. 15, 1977

[54] SCORE KEEPING UNITS

[76] Inventor: Vernon Kinser, McDonald Township, Barry County, Mo. 65677

[22] Filed: Dec. 8, 1975

[21] Appl. No.: 638,933

[52] U.S. Cl. ..... 273/1 ES; 235/92 GA; 340/323 R; 273/DIG. 26

[51] Int. Cl.[2] ..... A63B 71/06

[58] Field of Search ..... 273/1 ES, DIG. 26; 235/92 C, 92 GA; 340/323

[56] References Cited

UNITED STATES PATENTS 3,834,701 9/1974 Hashimoto ..... 273/DIG. 26

*Primary Examiner*—William H. Grieb
*Attorney, Agent, or Firm*—Ralph W. Kalish

[57] ABSTRACT

A score keeping unit for the game of horseshoes, adapted to make use of more than one counter to keep different kinds of score keeping data. Means is provided to trip each counter the required number of times but only through cooperation by way of the switches that control the units.

7 Claims, 4 Drawing Figures

SCORE KEEPING UNITS

This invention relates generally to a new score keeping unit.

More specifically my invention relates to score keeping for the well known game of horseshoes, which in its present form, is played by pitching hoseshoes at a stake as a target some distance from the player or players, the object being to score by encircling the stake or by coming as close to it as possible. (A horseshoe pitched so as to encircle the stake is called a "ringer" by the players in a game of horseshoes.)

To allow each player to keep his own score with no restrictions would invite dishonesty so usually the score keeping is accomplished manually by a non-player score keeper who keeps score on a score keeping sheet as the scores are announced by the players in the game of horseshoes, but the score keeper could make a mistake or be dishonest.

My present invention has, hence, for its prime object the provision of score keeping units, for use by the players in a game of horseshoes, that are operable for keeping scores but only through cooperation by way of all players, in such a manner as to practically eliminate the chances of making a mistake or dishonesty in keeping score.

And with the above and other objects in view, my invention resides in the novel features of form, construction, arrangement, and combination of parts presently described and pointed out in the claims.

In the accompanying drawings (one sheet) —

Figure 1:
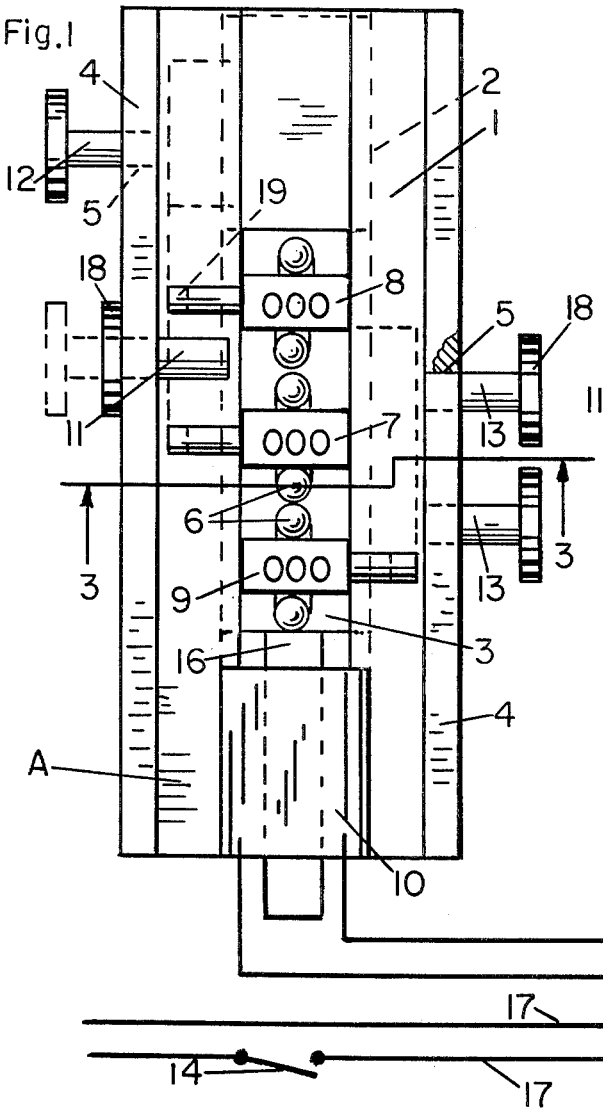
FIGS. 1 and 2 are elevated views of units A and B.

Referring now more in detail and by reference characters to the drawings, which illustrate practical embodiments of my invention, the usual number of players in a game of horseshoes is two so, therefore, I designate the equally disposed with respect to each other and identical score keeping units A and B for exclusive use by players C and D in the present example.

Each of the score keeping units A and B comprises a housing 1 which is provided with grooves 2 for slidable support of a carriage 3. Mounted on the carriage 3, by some suitable fastening elements as rivets 6, for movement in unison with the carriage 3 is the counters 7, 8, 9, each, disposed to record respective score keeping data, as will be explained more fully later.

Means is provided to actuate or trip the counters 7, 8, 9, for which purpose, the housing 1 or each unit A or B includes as an integral part a solenoid operator 10, the plunger 16 of which is disposed to move each respective carriage 3 and its complement of counters 7, 8, 9 along the grooves 2.

Then, holes 5 are provided and suitably spaced in the sidewalls 4 of each housing 1 to support the pins 11, 12, 13 each of which is equipped with a knob 18 and shiftable at the discretion of players C or D into respective positions to trip the counters 7, 8, 9 the required number of times, as they are moved along the grooves 2 by the solenoid operators 10, for score keeping response thereof.

Figure 4:
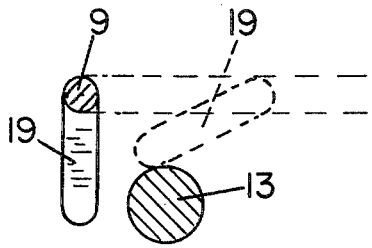
FIG. 4 is a view along line 4 — 4 of FIG. 2.

Referring to FIG. 4 which illustrates the preferred method used to trip the counters 7, 8, 9. As, in most cases where mechanical counters are to be installed, each counter 7, 8, 9 is both equipped with and responsive to a swingable member, as, lever 19. In the present case of counter 9, the pin 11 has been shifted and disposed with respect to lever 19 so that, for all present purposes, the lever 19 must swing before the counter 9 can be moved by the carriage 3.

It is important to discourage dishonesty on the part of any player in a game of horseshoes so, therefore, the controlling means or switches 14, 15 are mounted for exclusive respective use by the players C and D and are wired by means of the wires 17 into the same circuit with the solenoid operators 10 of units A and B in such a manner that movement of the carriages 3 by the solenoid operators 10 will always by subject to cooperation of players C and D by way of switches 14, 15.

Cancellation is the usual method of counting score in the game of horseshoes, that is, if players C and D both pitch one horseshoe, either both, or one, or none, will become ringers. In case both become ringers there is no score, or, cancellation. In case of one ringer the player pitching the ringer scores 2 points. In case of no ringers the player pitching the horseshoe closest to the stake socres 1 point. So, repeatedly, two horseshoes are pitched, one by each player, and score is kept until a final total score is reached by one of the players.

Most often, the game of horseshoes is played by pitching the horseshoes back and forth between two stakes, in which case, a separate score is kept at each stake. The disadvantage is that the total score is always the sum of the scores at each stake, but there is a very important advantage because any dispute as to whether or not the score has been recorded at either stake can be quickly resolved by referring back to counters 7 at the other stake.

Each of the counters 7, 8, 9 is disposed to record a separate kind of score keeping data. In the present instance, counters 7 are disposed to record the number of times player C or D has pitched a horseshoe, counters 8 are disposed to record the number of ringers player C or D has pitched, and counters 9 are disposed to record the total score of player C or D.

Figure 2:
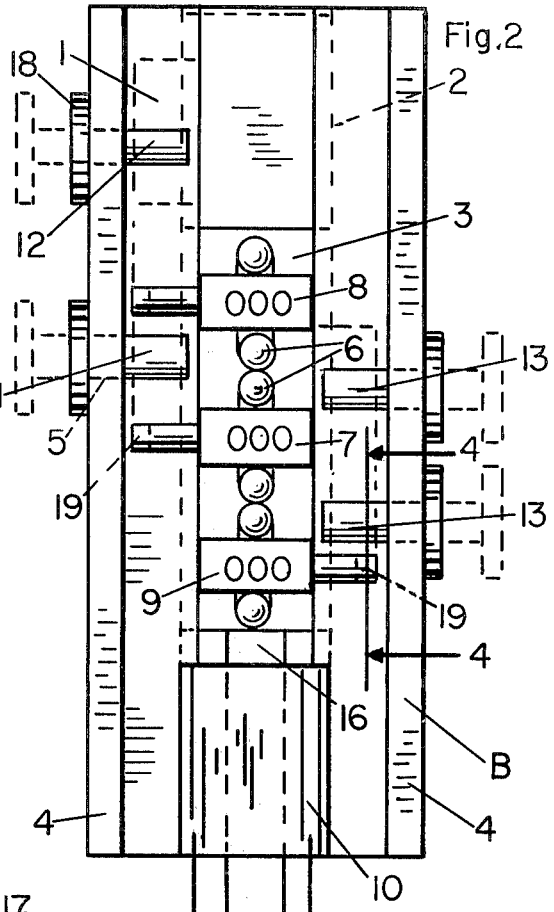
Figure 3:
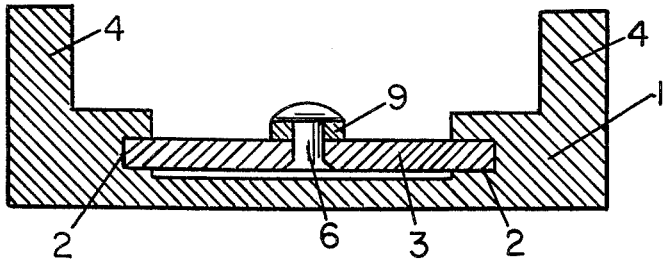
FIG. 3 is a transverse sectional view taken along line 3 — 3 of FIG. 1.

Thus, suppose that player C, after pitching one horseshoe has failed to cancel a ringer pitched by player D to allow player D to score. To record the score, player D shifts all the pins 11, 12, 13 into position to trip respective counters 7, 8, 9 as shown in FIG. 2. In the meantime player C has shifted pin 11 into position to trip counter 7 as shown in FIG. 1. Finally, players C and D close the respective switches 14, 15, the solenoid operators 10 move the carriages 3, and score keeping is completed for all present purposes.

So, a complete score keeping record is kept as the game of horseshoes between players C and D progresses to reveal every detail of the horseshoe game, the number of times each player C or D has pitched a horseshoe, the number of ringers each player C or D has pitched, and the total score.

It will be understood that, if desired, various changes and modifications in the form, construction, arrangement and combination of the parts of my score keeping units may be made and substituted for those herein shown and described without departing from the nature and principles of my invention.

Having thus described my invention, what I claim and desire to secure by letters patent is:

1. In scoring units of the kind described, in combination, a plurality of counters, a carriage on which said counters are mounted, a plurality of pin means to actuate said counters, said pin means being shiftable into position to trip said counters, solenoid operators disposed to move said carriage, and controlling means to control said carriage movement whereby when the pin means are shifted into said trippable positions and said controlling means operated, the carriage is moved by said solenoid to cause said pin means to trip said counters.

2. The invention defined in claim 1 and further characterized by said controlling means including first and second serially related, normally open switches.

3. In scoring units of the kind described, in combination, means defining a housing, a carriage slidably disposed in said housing, a plurality of counters mounted on said carriage for movement therewith, a counter trip element rockably carried on each counter, pin means disposable within the path of travel of said counter trip elements for optionable engagement therewith for tripping of the associated counter, and means effecting sliding of said carriage.

4. The invention as defined in claim 3 and further characterized by said counter trip elements being levers extending laterally from the associated counter, and said means effecting sliding of said carriage being a solenoid having an armature engaged to said carriage, and means for energizing said solenoid.

5. The invention as defined in claim 4 and further characterized by first and second control switches connected in series within said means for energizing said solenoid.

6. In scoring units of the kind described, in combination, first and second means defining first and second housings, a carriage slidably disposed in each of said first and second housings, a plurality of counters mounted on each carriage for travel therewith, a counter trip element rockably carried on each counter for travel therewith, pin means disposable within the path of travel of said counter trip elements for optionable engagement therewith for tripping of the associated counter, electrically operable means effecting sliding of said carriages, and first and second control switches in series included within said electrically operable means.

7. The invention as defined in claim 6 and further characterized by said electrically operable means being a solenoid in each housing, each solenoid having an armature engaging the related counter, a common source of electrical power connected in series to said solenoids in said first and second housings.

* * * * *